US006332931B1

(12) United States Patent
Das et al.

(10) Patent No.: US 6,332,931 B1
(45) Date of Patent: Dec. 25, 2001

(54) METHOD OF FORMING A DIFFUSION ALUMINIDE-HAFNIDE COATING

(75) Inventors: Nripendra N. Das, West Chester; Thomas E. Mantkowski, Madeira; Raymond W. Heidorn, Fairfield; Joshua L. Miller, West Chester; Jeffrey A. Pfaendtner, Blue Ash, all of OH (US)

(73) Assignee: General Electric Company, Cincinnati, OH (US)

( * ) Notice: Subject to any disclaimer, the term of this patent is extended or adjusted under 35 U.S.C. 154(b) by 0 days.

(21) Appl. No.: 09/474,550

(22) Filed: Dec. 29, 1999

(51) Int. Cl.[7] ..... C23C 8/00

(52) U.S. Cl. ..... 148/240; 148/277; 148/283; 427/253; 427/255.26

(58) Field of Search ..... 148/240, 277, 148/283; 427/252, 253, 255.26, 255.28, 255.39, 255.32, 255.34

(56) References Cited

U.S. PATENT DOCUMENTS

| | | | | |
|---|---|---|---|---|
| 3,486,927 | * | 12/1969 | Gauje | 427/253 |
| 3,598,638 | | 8/1971 | Levine | 117/107.2 P |
| 3,951,642 | | 4/1976 | Chang et al. | 75/255 |
| 3,961,910 | | 6/1976 | Baladjanian et al. | 29/197 |
| 3,993,454 | * | 11/1976 | Giggins, Jr. et al. | 428/553 |
| 5,817,371 | | 10/1998 | Gupta et al. | 427/454 |
| 5,897,966 | | 4/1999 | Grossklaus, Jr. et al. | 428/652 |
| 6,020,075 | | 2/2000 | Gupta et al. | 428/612 |
| 6,146,696 | | 11/2000 | Das et al. | 427/253 |
| 6,168,874 | | 1/2001 | Gupta et al. | 428/623 |
| 6,174,448 | | 1/2001 | Das et al. | 216/2 |

OTHER PUBLICATIONS

U.S. application No. 09/474,548, Mantkowski et al., filed Dec. 29, 1999.

U.S. application No. 09/474,549, Das et al., filed Dec. 29, 1999.

* cited by examiner

*Primary Examiner*—John Sheehan
*Assistant Examiner*—Andrew L. Olfmans
(74) *Attorney, Agent, or Firm*—Andrew C. Hess; V. Ramaswamy

(57) ABSTRACT

A process for forming a diffusion aluminide-hafnide coating on an article, such as a component for a gas turbine engine. The process is a vapor phase process that generally entails placing the article in a coating chamber containing a halide activator and at least one donor material. The donor material collectively consists essentially of at least 0.5 weight percent hafnium and at least 20 weight percent aluminum with the balance being chromium and/or cobalt.

20 Claims, 1 Drawing Sheet

METHOD OF FORMING A DIFFUSION ALUMINIDE-HAFNIDE COATING

FIELD OF THE INVENTION

The present invention relates to processes for forming protective diffusion coatings. More particularly, this invention relates to a process of forming a diffusion aluminide-hafnide coating by vapor phase deposition.

BACKGROUND OF THE INVENTION

The operating environment within a gas turbine engine is both thermally and chemically hostile. Significant advances in high temperature capabilities have been achieved through the development of iron, nickel and cobalt-base superalloys and the use of oxidation-resistant environmental coatings capable of protecting superalloys from oxidation, hot corrosion, etc.

Diffusion aluminide coatings have particularly found widespread use for superalloy components of gas turbine engines. These coatings are generally formed by such methods as diffusing aluminum deposited by chemical vapor deposition (CVD) or slurry coating, or by a diffusion process such as pack cementation, above-pack, or vapor (gas) phase deposition. As depicted in FIG. 1, a diffusion aluminide coating 12 generally has two distinct zones, the outermost of which is an additive layer 16 containing an environmentally-resistant intermetallic represented by MAl, where M is iron, nickel or cobalt, depending on the substrate material. The MAl intermetallic is the result of deposited aluminum and an outward diffusion of iron, nickel or cobalt from the substrate 10. Beneath the additive layer 16 is a diffusion zone 14 comprising various intermetallic and metastable phases that form during the coating reaction as a result of diffusional gradients and changes in elemental solubility in the local region of the substrate 10. During high temperature exposure in air, the additive layer 16 forms a protective aluminum oxide (alumina) scale or layer (not shown) that inhibits oxidation of the diffusion coating 12 and the underlying substrate 10.

Diffusion processes generally entail reacting the surface of a component with an aluminum-containing gas composition. In pack cementation processes, the aluminum-containing gas composition is produced by heating a powder mixture of an aluminum-containing source (donor) material, a carrier (activator) such as an ammonium or alkali metal halide, and an inert filler such as calcined alumina. The ingredients of the powder mixture are mixed and then packed and pressed around the component to be treated, after which the component and powder mixture are heated to a temperature sufficient to vaporize and react the activator with the source material to form the volatile aluminum halide, which then reacts at the surface of the component to form the diffusion aluminide coating.

In contrast to pack processes, a diffusion aluminide coating can be formed by vapor phase deposition without the use of an inert filler. In addition, the source material can be an aluminum alloy or an aluminum halide. If the source material is an aluminum halide, a separate activator is not required. Also contrary to pack processes, the source material is placed out of contact with the surface to be aluminized. Similar to pack processes, vapor phase aluminizing (VPA) is performed at a temperature at which the activator or aluminum halide will vaporize, forming an aluminum halide vapor that reacts at the surface of the component to form a diffusion aluminide coating. VPA processes avoid significant disadvantages of pack processes, such as the use of an inert filler that must be discarded, the use of a source material that is limited to a single use, and the tendency for pack powders to obstruct cooling holes in air-cooled components.

While simple aluminide coatings are widely employed to protect gas turbine components, improved environmental coatings are continuously sought. The inclusion of limited amounts of hafnide intermetallics in an aluminide coating has been found to improve the environmental protection life beyond that possible with simple aluminide coatings. In the past, diffusion aluminide-hafnide coatings have been formed by a pack process in which a powder mixture of aluminum metal, hafnium metal, a halide activator and an inert filler is packed around the component to be treated. When sufficiently heated, the halide activator vaporizes and reacts with the aluminum and hafnium source materials to form volatile aluminum and hafnium halides, which then react at the component surface to form the diffusion aluminide-hafnide coating. A second method that has been used to form diffusion aluminide-hafnide coatings is chemical vapor deposition (CVD), in which aluminum and hafnium vapors are generated by flowing a halide gas through aluminum and hafnium metal sources. The vapors are then flowed into a coating chamber where they deposit to form a diffusion aluminide-hafnide coating on a component within the coating chamber.

Though used with success, pack cementation processes used to form diffusion aluminide-hafnide coatings share the same disadvantages as those noted when forming simple aluminide coatings, namely, the need for an inert filler, the obstruction of cooling holes, the aluminum and hafnium powders must be discarded or reprocessed after a single use. The dust associated with the use of aluminum and hafnium powders is also undesirable. While avoiding these shortcomings, a significant disadvantage of using a CVD process to form an aluminide-hafnide coating is the considerable equipment cost. In view of these disadvantages of pack and CVD processes, alternative deposition methods for diffusion aluminide-hafnide coatings have been sought. However, a significant obstacle to the use of other methods such as vapor phase processes has been the ability to control hafnium transfer, the result of which can lead to excessive or otherwise uncontrolled hafnium levels in the coating.

BRIEF SUMMARY OF THE INVENTION

The present invention generally provides a process for forming a diffusion aluminide-hafnide coating on an article, such as a component for a gas turbine engine. The process is a vapor phase process that generally entails placing the article in a coating chamber containing a halide activator and at least one donor material, without any inert filler present. According to this invention, the donor material should collectively consist essentially of at least 0.5 weight percent hafnium and at least 20 weight percent aluminum with the balance being chromium, iron, cobalt and/or another aluminum alloying agent with a higher melting point. For example, the donor material may be a single metallic alloy consisting essentially of at least 0.5 weight percent hafnium, at least 20 weight percent aluminum, and the balance chromium or cobalt. Alternatively, the donor material could be provided in the form of two (or more) metallic compositions, a first consisting essentially of hafnium or a hafnium alloy, while the second is essentially an alloy of aluminum and either chromium, cobalt or another higher melting alloying agent.

In accordance with vapor phase processing, the article remains out of contact with the donor material during the coating process. In an inert or reducing atmosphere, coating is initiated by heating the article, the halide activator and the donor material to vaporize the halide activator, which then reacts with the hafnium and aluminum of the donor material to produce aluminum halide and hafnium halide vapors. These vapors then react at the surface of the article to form a diffusion aluminide-hafnide coating on the article surface. The composition of a coating formed in accordance with the invention is generally about 0.5 to about 60 weight percent hafnium and about 12 to about 38 weight percent aluminum, generally present as hafnide and aluminide intermetallics. The hafnium and aluminum available at the surfaces of the donor material are reacted by the activator to deposit on the article, and therefore their relative surface areas generally determine the relative amounts of hafnium and aluminum that will be present in the coating. In addition, the available hafnium and aluminum at the surfaces of the donor material determine the vapor generation rate during coating, which in turn is the rate-limiting step in the coating process.

In view of the above, the process of this invention is able to produce a diffusion aluminide-hafnide coating without the disadvantages associated with pack cementation processes, such as the production of large quantities of byproduct as a result of pack powders being limited to a single use. The vapor phase process of this invention also avoids the equipment investment required by CVD processes.

Other objects and advantages of this invention will be better appreciated from the following detailed description.

DETAILED DESCRIPTION OF THE INVENTION

Figure 1:
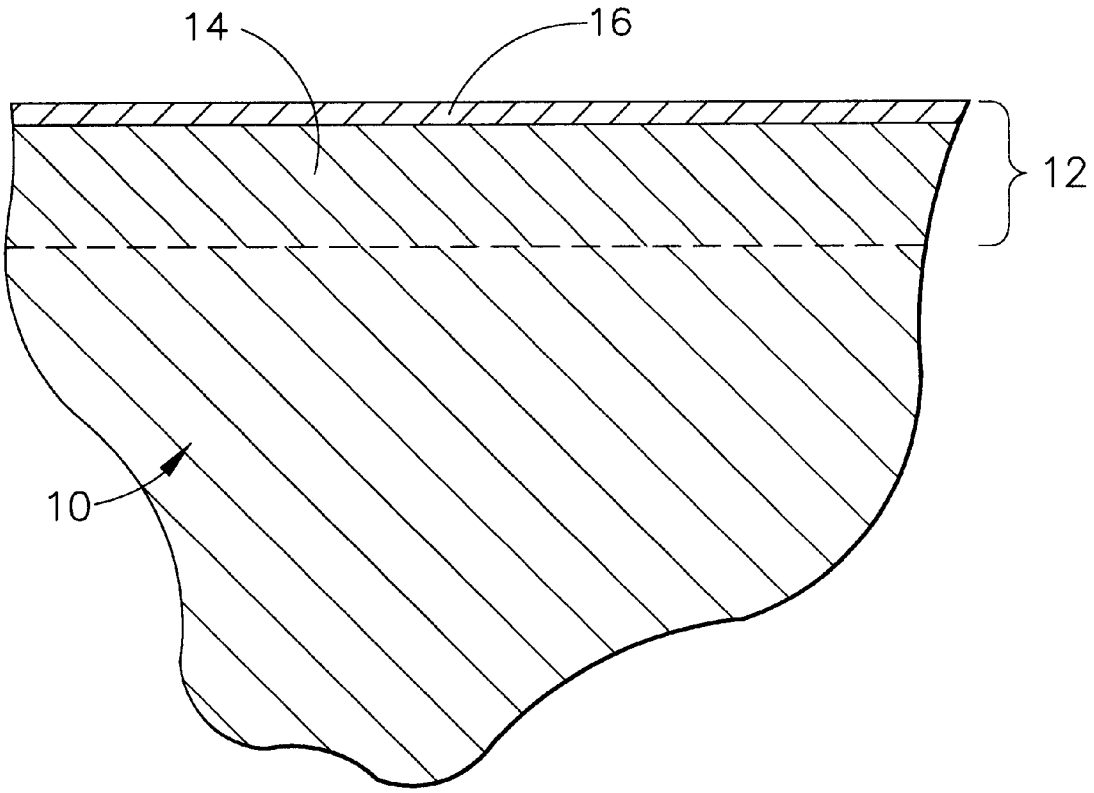
FIG. 1 represents a partial cross-sectional view of a substrate with a diffusion aluminide-hafnide coating produced in accordance with this invention.

The present invention is generally applicable to components that operate within thermally and chemically hostile environments, and are therefore subjected to oxidation and hot corrosion. Notable examples of such components include the high and low pressure turbine nozzles, blades and shrouds of gas turbine engines. While the advantages of this invention will be described with reference to gas turbine engine hardware, the teachings of the invention are generally applicable to any component on which an aluminide-hafnide coating may be used to protect the component from its hostile operating environment.

FIG. 1 represents a diffusion coating 12 produced by the method of this invention. The coating 12 is shown as overlying a substrate 10, which is typically the base material of the component protected by the coating 12. Typical materials for the substrate 10 (and therefore the component) include nickel, iron and cobalt-base superalloys, though other alloys could be used. The diffusion coating 12 is depicted as an outward-type coating characterized by an additive layer 16 that overlies a diffusion zone 14. The diffusion coating 12 of this invention is an aluminide-hafnide coating, such that the additive layer 16 contains oxidation-resistant nickel-aluminide-hafnide inter-metallic phases. The additive layer 16 may also contain other intermetallic phases, depending on whether other metals were deposited or otherwise present on the substrate 10 prior to aluminizing. For example, the additive layer 16 may include $PtAl_2$ or platinum in solution in the MAl phase if platinum was plated on the substrate 10 prior to forming the aluminide coating 12. An inward-type diffusion coating would generally differ from the outward-type coating 12 shown in FIG. 1 by having a thicker additive layer that primarily extends into and below the original substrate surface, but is otherwise compositionally similar. Diffusion coatings of both types form an oxide scale (not shown) on their surface during exposure to engine environments. The oxide scale inhibits oxidation of the diffusion coating 12 and substrate 10. A suitable thickness for the coating 12 is typically about 25 to 125 micrometers (about 0.001–0.005 inch).

According to this invention, the coating 12 is formed by a vapor phase process by which aluminum and hafnium are co-deposited on the substrate 10 to form aluminide and hafnide intermetallics. While similar to prior art vapor phase processes, which includes sharing certain advantages associated with vapor phase deposition, the method of this invention employs a combination of aluminum and hafnium donor sources that, in the presence of an appropriate amount of carrier, will form an effective environmental coating for gas turbine engine components.

As with conventional vapor phase deposition processes known in the art, the vapor phase process of this invention is carried out in an inert or reducing atmosphere (such as argon or hydrogen, respectively) within a coating chamber (retort) that contains the component to be coated, a source (donor) material, and one or more carriers (activators). The activators react with the donor material to generate the coating vapors (e.g., volatile aluminum and hafnium halides) that react at the surface of the component to form the diffusion aluminide-hafnide coating 12. According to the invention, the donor material can be present in the coating chamber as a single metallic mass, or individual metallic masses. In either case, the donor material present in the coating chamber-consists essentially of at least 0.5 weight percent hafnium and at least 20 weight percent aluminum, with the balance being chromium and/or cobalt. As an example, the donor material may be present as a single mass of an aluminum-hafnium-chromium or an aluminum-hafnium-cobalt alloy, or as two metallic masses, a first consisting essentially of hafnium or a hafnium alloy such as a hafnium-zirconium alloy, while the second consists essentially of an aluminum-chromium or an aluminum-cobalt alloy. A particularly suitable composition for the donor material (singly or collectively) is at least 0.5 to about 10 weight percent hafnium and at least 20 to about 55 weight percent aluminum, with the balance being chromium or cobalt. A more preferred composition is about 0.5 to about 4 weight percent hafnium and about 25 to about 35 weight percent aluminum, with the balance being chromium or cobalt.

The carrier is a halide activator that is present in an amount of about 60 to about 200 grams per cubic foot of container volume, preferably about 120 grams per cubic foot of container volume. Suitable halide activators include $NH_4F$, NaF, KF, $NH_4Cl$, $AlF_3$, $NH_4HF_2$ and $AlCl_3$, which may be present as a powder within the coating chamber. $AlF_3$ is a preferred activator used in amounts of about 0.7 to 2.4 moles per cubic foot of container volume, though the other halide activators noted above could be substituted for $AlF_3$ if used in amounts to achieve an equivalent level of activator activity. Conventional coating conditions can otherwise be used and maintained in the chamber, including the use of coating temperatures of about 950 degrees Centigrade to about 1150 degrees Centigrade, and coating durations of about two to about ten hours. A preferred minimum treatment is a coating temperature of at least 980 degrees Centigrade maintained for a duration of at least three hours.

During an investigation leading to this invention, nickel-base superalloy substrates were provided with diffusion aluminide-hafnide coatings using hafnium and a chromium-aluminum alloy as discrete donor materials. Hafnium constituted about 0.5 weight percent of the total donor mass, with the balance being the CrAl alloy, such that aluminum constituted about 30 weight percent of the total donor mass. The halide activator used was aluminum fluoride present in an amount of about 120 g/ft$^3$ of the coating container volume. The vapor phase process was performed at about 1080 degrees Centigrade for a duration of about five hours, yielding a diffusion aluminide-hafnide coating with an additive layer having a thickness of about 60 micrometers and containing about 43 weight percent hafnium, about 23 weight percent aluminum, with nickel essentially accounting for the balance of about 34 weight percent. It is believed that diffusion aluminide-hafnide coatings can be produced to contain about 0.5 to about 60 weight percent hafnium and about 12 to about 38 weight percent aluminum, with the balance being the base material (e.g., nickel) of the substrate by varying the composition of the donor material within the ranges stated above.

While the invention has been described in terms of a preferred embodiment, it is apparent that other forms could be adopted by one skilled in the art. Accordingly, the scope of the invention is to be limited only by the following claims.

What is claimed is:

1. A process for forming a diffusion aluminide-hafnide coating, the process comprising the steps of:

placing an article in a coating chamber containing a halide activator and at least one donor material, the donor material collectively consisting essentially of at least 0.5 weight percent hafnium and at least 20 weight percent aluminum with the balance being a material with a higher melting point than aluminum, both the hafnium and the aluminum being available at the surfaces of the donor material, the article being out of contact with the halide activator and the donor material; and then in an inert or reducing atmosphere, heating the article, the halide activator and the donor material to react the hafnium and aluminum at the surfaces of the donor material with the halide activator and produce a halide vapor that reacts at the surface of the article to form a diffusion aluminide-hafnide coating on the surface.

2. A process according to claim 1, wherein the donor material consists of a single metallic alloy consisting essentially of at least 0.5 weight percent hafnium, at least 20 weight percent aluminum, and the balance chromium or cobalt.

3. A process according to claim 1, wherein the donor material consists of two metallic compositions, a first of the metallic compositions consisting essentially of hafnium or a hafnium-zirconium alloy, a second of the metallic compositions consisting essentially of aluminum and either chromium or cobalt.

4. A process according to claim 1, wherein the halide activator is chosen from the group consisting of $NH_4F$, NaF, KF, $NH_4Cl$, $AlF_3$, $NH_4HF_2$ and $AlCl_3$, and is present in an amount sufficient to achieve a level of activator activity equal to about 0.7 to about 2.4 moles of $AlF_3$ per cubic foot of coating chamber volume.

5. A process according to claim 1, wherein the article, the halide activator and the donor material are heated to at least 980 degrees Centigrade for a duration of at least three hours.

6. A process according to claim 1, wherein the halide activator and the donor material are heated to about 1080 degrees Centigrade for a duration of about five hours.

7. A process according to claim 1, wherein the diffusion aluminide-hafnide coating comprises about 0.5 to about 60 weight percent hafnium and about 12 to about 38 weight percent aluminum, the process further comprising the step of selecting the relative amounts of hafnium and aluminum available at the surfaces of the donor material to determine the relative amounts of hafnium and aluminum in the diffusion aluminide-hafnide coating.

8. A process according to claim 1, wherein the article is formed of a superalloy.

9. A process according to claim 1, wherein the article is formed of a nickel-base or cobalt-base superalloy, and the diffusion aluminide-hafnide coating comprises about 0.5 to about 60 weight percent hafnium, about 12 to about 38 weight percent aluminum, and the balance nickel or cobalt.

10. A process according to claim 1, wherein the article is a gas turbine engine component.

11. A process for forming a diffusion aluminide-hafnide coating on a superalloy component of a gas turbine engine, the process comprising the steps of:

placing the superalloy component in a coating chamber containing at least one donor material and a halide activator, the halide activator being present in an amount sufficient to achieve a level of activator activity equal to about 0.7 to about 2.4 moles of $AlF_3$ per cubic foot of coating chamber volume, the donor material collectively consisting essentially of at least 0.5 to about 10 weight percent hafnium, at least 20 to about 55 weight percent aluminum, the balance chromium or cobalt, both the hafnium and the aluminum being available at the surfaces of the donor material, the component being out of contact with the halide activator and the donor material; and then in an inert or reducing atmosphere, heating the component, the halide activator and the donor material to at least 980° C. for a duration of at least three hours, so that the hafnium and aluminum of the donor material react with the halide activator and produce a halide vapor that reacts at the surface of the component to form a diffusion aluminide-hafnide coating on the surface;

wherein the relative amounts of hafnium and aluminum available at the surfaces of the donor material are selected to determine the relative amounts of hafnium and aluminum in the difflusion aluminide-hafnide coating.

12. A process according to claim 11, wherein the donor material consists of a single metallic alloy consisting essentially of at least 0.5 to about 10 weight percent hafnium, at least 20 to about 55 weight percent aluminum, the balance chromium or cobalt.

13. A process according to claim 11, wherein the donor material consists of two metallic compositions, a first of the metallic compositions consisting essentially of hafnium or a hafnium alloy, a second of the metallic compositions consisting essentially of either a CrAl alloy or a CoAl alloy.

14. A process according to claim 11, wherein the halide activator is $AlF_3$.

15. A process according to claim 11 wherein the halide activator is $AlF_3$ and the component, the halide activator and the donor material are heated to about 1080 degrees Centigrade for a duration of about five hours.

16. A process according to claim 11, wherein the diffusion aluminide-hafnide coating comprises about 0.5 to about 60 weight percent hafnium and about 12 to about 38 weight percent aluminum.

17. A process according to claim 11, wherein the component is formed of a nickel-base or cobalt-base superalloy, and the diffusion aluminide-hafnide coating comprises about 0.5 to about 60 weight percent hafnium, about 12 to about 38 weight percent aluminum, and the balance nickel or cobalt.

18. A process according to claim 11, wherein the donor material collectively consists essentially of at least 0.5 to about 4 weight percent hafnium, at least 25 to about 35 weight percent aluminum, the balance chromium or cobalt.

19. A process according to claim 18, wherein the donor material consists of a single metallic alloy consisting essentially of hafnium, aluminum, and either chromium or cobalt.

20. A process according to claim 18, wherein the donor material consists of two metallic compositions, a first of the metallic compositions consisting essentially of hafnium or a hafnium alloy, a second of the metallic compositions consisting essentially of either a CrAl alloy or a CoAl alloy.

* * * * *